US007507186B2

(12) United States Patent
Stearns et al.

(10) Patent No.: US 7,507,186 B2
(45) Date of Patent: Mar. 24, 2009

(54) EXERCISE METHODS AND APPARATUS WITH ELLIPTICAL FOOT MOTION

(76) Inventors: Kenneth W. Stearns, P.O. Box 55912, Houston, TX (US) 77255; Joseph D. Maresh, P.O. Box 645, West Linn, OR (US) 97068-0645; Mark A. Krull, P.O. Box 7198, Bend, OR (US) 97708

( * ) Notice: Subject to any disclaimer, the term of this patent is extended or adjusted under 35 U.S.C. 154(b) by 0 days.

(21) Appl. No.: 11/977,036

(22) Filed: Oct. 23, 2007

(65) Prior Publication Data

US 2008/0227602 A1 Sep. 18, 2008

Related U.S. Application Data

(60) Provisional application No. 60/918,274, filed on Mar. 14, 2007.

(51) Int. Cl.
*A63B 22/06* (2006.01)
*A63B 69/16* (2006.01)

(52) U.S. Cl. ..... 482/52; 482/57; 482/62

(58) Field of Classification Search ..... 482/51–53, 482/57, 62, 70, 79–80
See application file for complete search history.

(56) References Cited

U.S. PATENT DOCUMENTS 5,540,637 A * 7/1996 Rodgers, Jr. ..... 482/52
5,766,113 A * 6/1998 Rodgers, Jr. ..... 482/52
6,422,977 B1 * 7/2002 Eschenbach ..... 482/52
6,454,682 B1 * 9/2002 Kuo ..... 482/52
7,223,209 B2 * 5/2007 Lee ..... 482/52
7,316,633 B2 * 1/2008 Liao et al. ..... 482/52

* cited by examiner

*Primary Examiner*—Steve R Crow

(57) ABSTRACT

An exercise apparatus includes a frame configured to rest on a floor surface; left and right rocker links pivotally mounted on the frame; left and right reciprocating links having forward ends rotatably coupled to respective rocker links, and rearward ends constrained to move in reciprocal fashion relative to the frame; left and right cranks rotatably mounted on the frame; left and right drive links having forward ends rotatably coupled to respective cranks, and rearward ends rotatably coupled to intermediate portions of respective reciprocating members; and left and right foot links having forward ends rotatably coupled to respective rocker links, and rearward, foot supporting ends supported by respective drive links for both rotational and translational movement relative thereto. The resulting linkage assemblies constrain the foot supporting ends to move through elliptical paths, and the paths may be altered by adjusting various components of the linkage assemblies relative to one another and/or the frame.

24 Claims, 7 Drawing Sheets

EXERCISE METHODS AND APPARATUS WITH ELLIPTICAL FOOT MOTION

CROSS-REFERENCE TO RELATED APPLICATIONS

Disclosed herein is subject matter entitled to the filing date of U.S. Provisional Application No. 60/918,274, filed Mar. 14, 2007.

FIELD OF THE INVENTION

The present invention relates to exercise methods and apparatus, and more specifically, to exercise equipment that guides a person's feet through generally elliptical paths of motion.

BACKGROUND OF THE INVENTION

Exercise equipment has been designed to facilitate a variety of exercise motions. For example, treadmills allow a person to walk or run in place; stepper machines allow a person to step or climb in place; bicycle machines allow a person to pedal in place; and still other machines allow a person to ski and/or stride in place.

Yet another type of exercise equipment has been designed to facilitate relatively more complicated exercise motions and/or to better simulate the human striding motion. This equipment typically uses a linkage assembly to convert a relatively simple motion, such as circular, into a relatively more complex motion, such as elliptical. Examples of these elliptical motion exercise machines are disclosed in U.S. Pat. No. 4,185,622 to Swenson; U.S. Pat. No. 5,279,529 to Eschenbach; U.S. Pat. No. 5,383,829 to Miller; U.S. Pat. No. 5,540,637 to Rodgers, Jr.; U.S. Pat. No. 5,882,281 to Stearns et al.; U.S. Pat. No. 6,080,086 to Maresh et al.; and U.S. Pat. No. 6,454,682 to Kuo, all of which are incorporated herein by reference to help provide context for better understanding of the subject invention.

SUMMARY OF THE INVENTION

Generally speaking, the present invention provides novel linkage assemblies and corresponding exercise apparatus that facilitate coordinated total body exercise. On a preferred embodiment, a frame is configured to rest on a floor surface, and left and right cranks are rotatably mounted on the frame. Left and right drive links have forward ends that are rotatably coupled to respective cranks, intermediate portions that are constrained to move in reciprocal fashion relative to the frame, and rearward ends that are constrained to move through respective elliptical paths. Left and right reciprocating links have intermediate portions that are rotatably coupled to the intermediate portions of respective left and right drive links, rearward ends that are constrained to move through respective reciprocal paths relative to the frame, and forward ends that are also constrained to move through respective reciprocal paths relative to the frame. Left and right rocker links are rotatably mounted on the frame at a common pivot axis, and have lower portions that are rotatably coupled to the forward ends of respective reciprocating links. The rocker links preferably have upper distal ends that are sized and configured for grasping. Left and right foot links have forward ends that are rotatably coupled to lower ends of respective rocker links, and rearward, foot supporting ends that are supported by the rearward ends of respective drive links for both pivotal and translational movement relative thereto. On certain alternative embodiments, the rearward ends of the foot links are supported by respective reciprocating links for both pivotal and translational movement relative thereto. In both instances, the resulting linkage assemblies constrain the foot supporting ends to move through elliptical paths, and the paths may be altered by adjusting various components of the linkage assemblies relative to one another and/or the frame. Additional features and/or advantages of the present invention will become apparent from the more detailed description that follows.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 1:
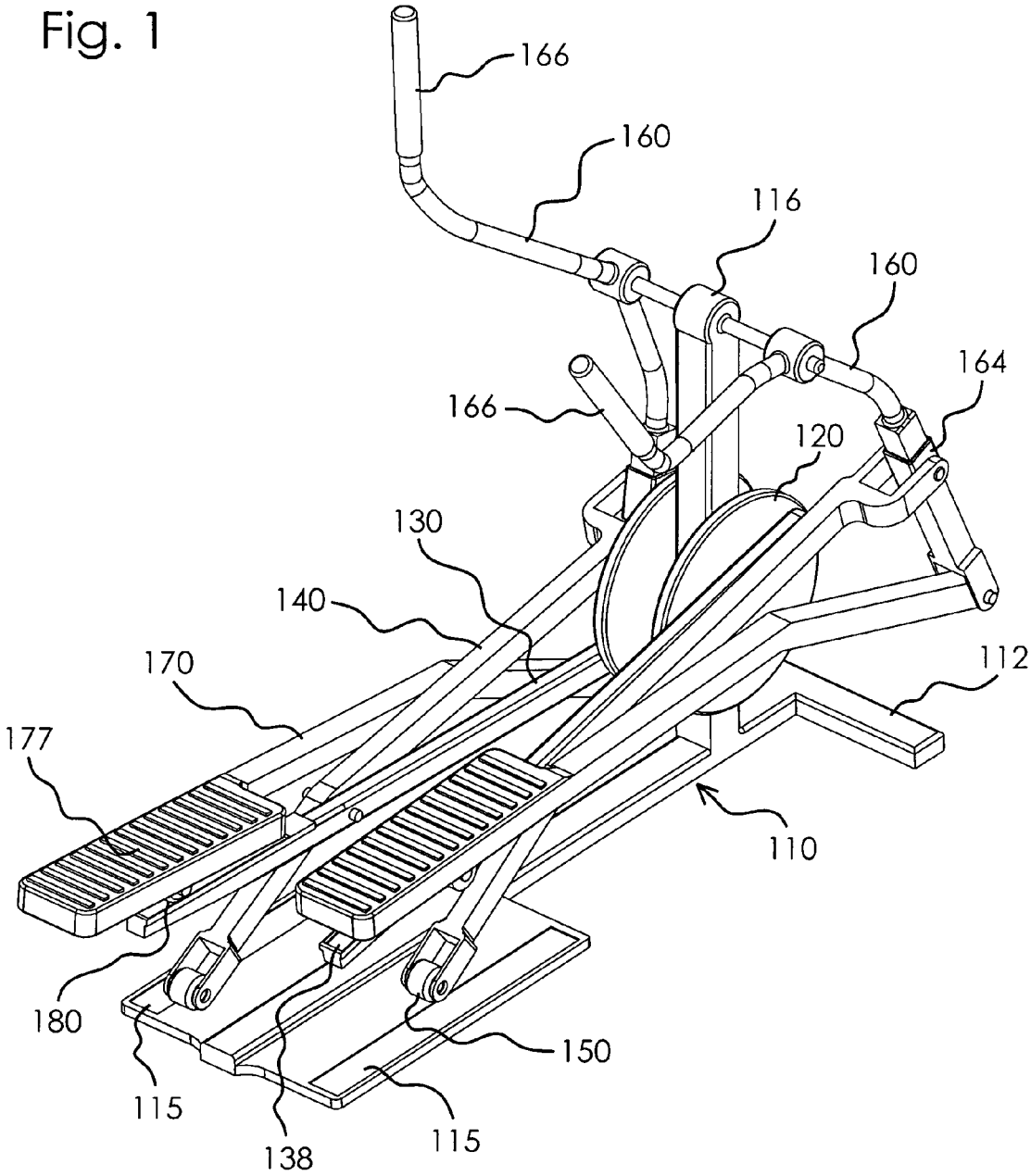
FIG. 1 is a perspective view of an exercise apparatus constructed according to the principles of the present invention.

The present invention involves elliptical motion exercise machines, and methods that link so-called "elliptical motion" of left and right foot supports to rotation of left and right cranks and/or arcuate motion of left and right handlebars. The term "elliptical motion" is intended in a broad sense to describe a closed-loop path of motion having a relatively longer, major axis and a relatively shorter, minor axis (which extends perpendicular to the major axis). In general, the present invention may be said to use displacement of the cranks to move the foot supports in a direction coincidental with the minor axis, and amplified displacement of crank driven members to move the foot supports in a direction coincidental with the major axis. As a result, the length of the minor axis is more directly a function of the crank diameter, while the length of the major axis is not so restricted.

A preferred embodiment of the present invention is designated as 100 in FIGS. 1-6. The exercise apparatus 100 may be described in terms of a frame 110, and left and right linkage assemblies movably mounted on the frame 110 (and linked to one another). The apparatus 100 is generally symmetrical about a vertical plane extending lengthwise through the frame 110. The linkage assembly components on the left side of the machine are preferably one hundred and eighty degrees out of phase relative to their opposite side counterparts.

The frame 110 includes a floor engaging base 112, left and right guides or tracks 115 mounted on a rearward end of the base 112, and a forward stanchion 116 that extends upward from an opposite, forward end of the base 112. A conventional user interface (not shown) may be mounted on top of the forward stanchion 116 to perform a variety of functions, including (1) displaying information to the user regarding items such as (a) exercise parameters and/or programs, (b) the current parameters and/or a currently selected program, (c) the current time, (d) the elapsed exercise time, (e) the current speed of exercise, (f) the average speed of exercise, (g) the number of calories burned during exercise, (h) the simulated distance traveled during exercise, and/or (i) data transmitted over the internet; and (2) allowing the user to (a) select or change the information being viewed, (b) select or change an exercise program, (c) adjust the speed of exercise, (d) adjust the resistance to exercise, (e) adjust the orientation of the exercise motion, and/or (f) immediately stop the exercise motion.

A shaft or axle is rotatably mounted on the forward stanchion 116, thereby defining a crank axis, and left and right cranks 120 are secured to respective ends of the shaft. The left and right cranks 120 are keyed to the shaft and thereby constrained to rotate together relative to the frame 110. As a matter of design choice, various known inertia altering devices, including flywheels and/or resistance brakes, for example, may be connected to the cranks, either directly or in "stepped-up" fashion using a belt and different diameter drums.

In addition to a respective crank 120, each linkage assembly also includes a drive link 130 having a forward end that is rotatably coupled to a respective crank 120, an intermediate portion that is rotatably coupled to a respective reciprocating link 140, and a rearward end that moves through an elliptical path. Each reciprocating member 140 has a rearward end that is rotatably coupled to a respective roller 150, an intermediate portion that is rotatably coupled to a respective drive link 130, as described above, and a forward end that is rotatably coupled to a respective rocker link 160. The rollers 150 are configured and arranged to roll back and forth along respective tracks 115, and each roller 150 may also be described as cooperating with a respective track 115 to constrain an respective rearward end to move in reciprocal fashion relative to the frame 110.

Figure 2:
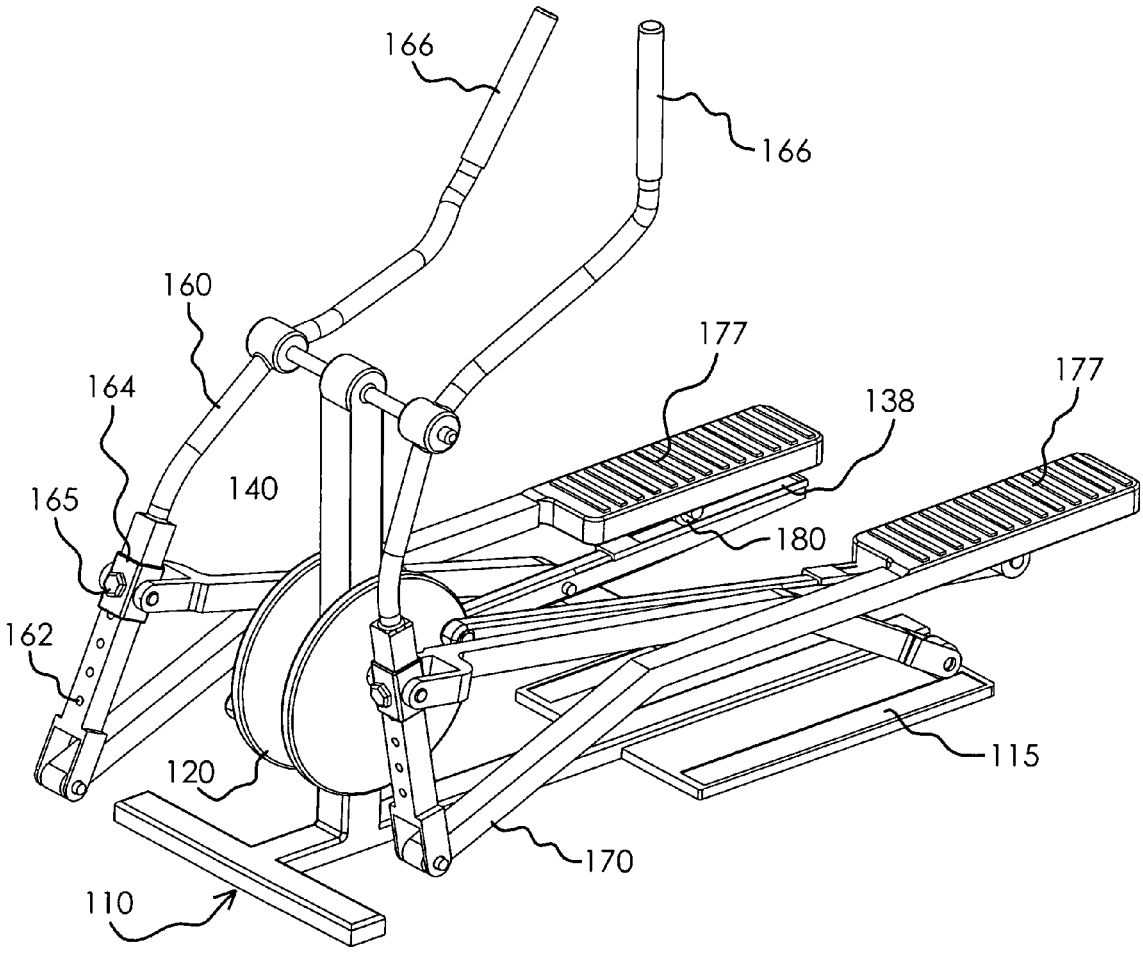
FIG. 2 is a different perspective view of the exercise apparatus of FIG. 1.
Figure 3:
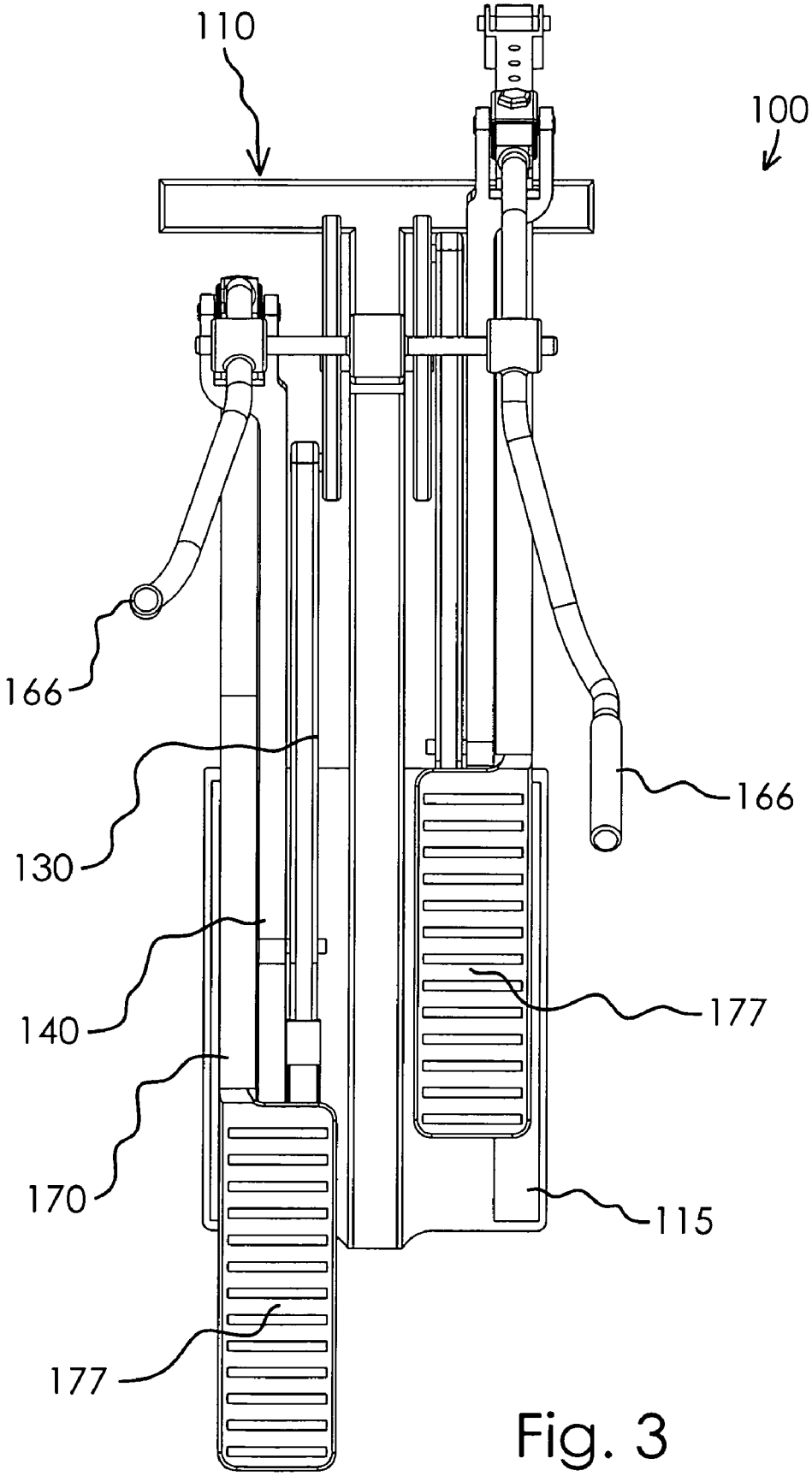
FIG. 3 is a top view of the exercise apparatus of FIG. 1.
Figure 4:
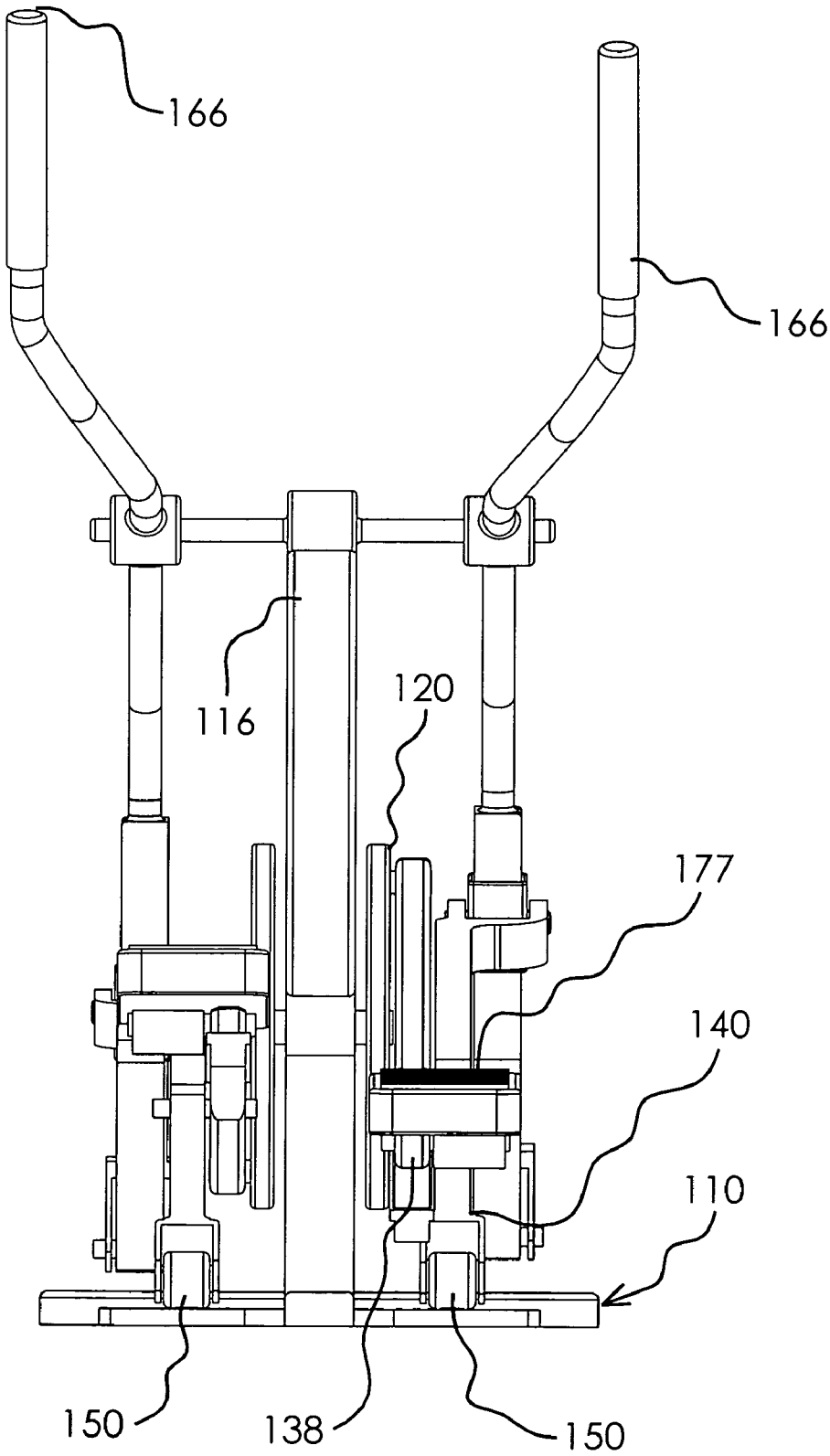
FIG. 4 is a rear view of the exercise apparatus of FIG. 1.
Figure 5:
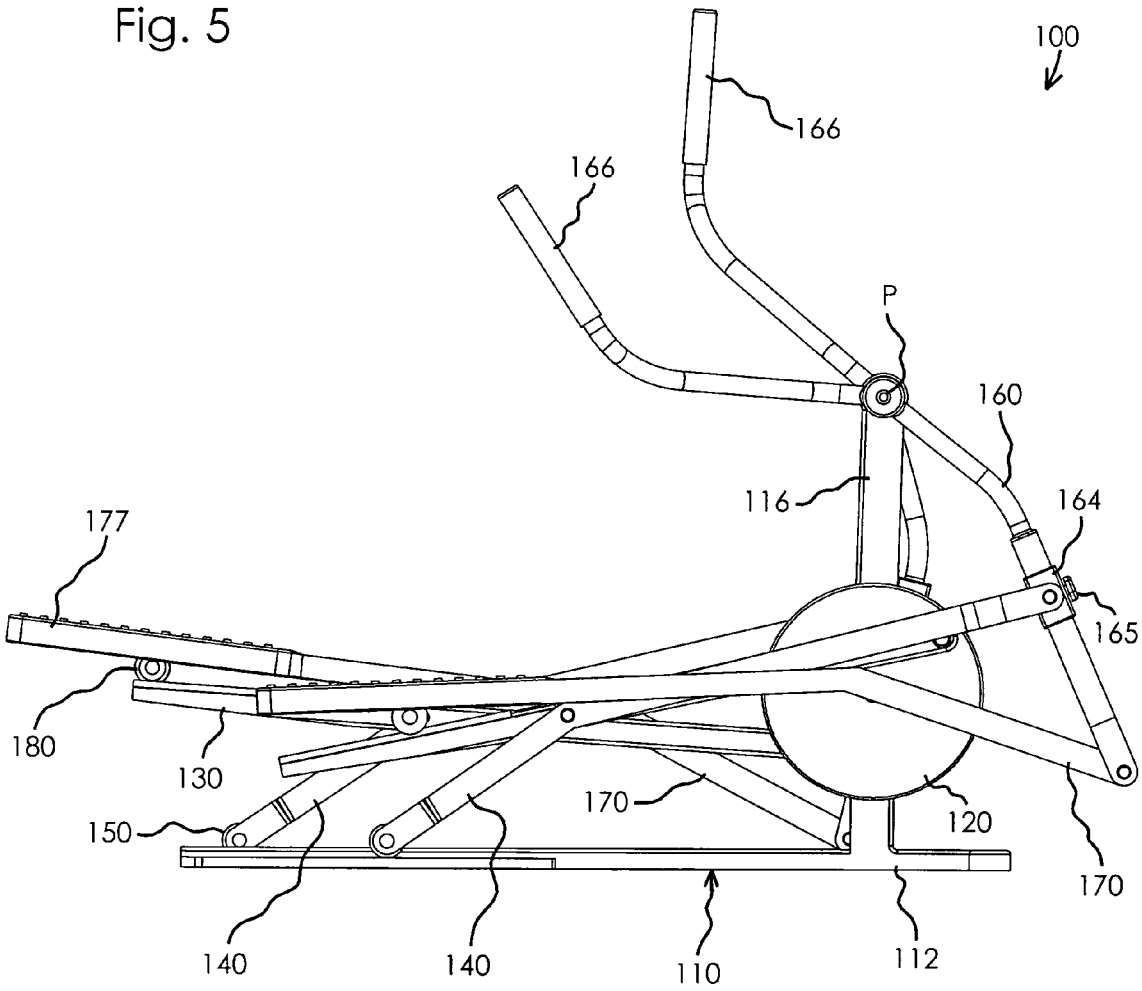
FIG. 5 is a side view of the exercise apparatus of FIG. 1.

An intermediate portion of each rocker link 160 is rotatably mounted on a respective side of the forward stanchion 116, thereby defining a common pivot axis designated as P in FIG. 5. Each rocker link 160 has an upper distal end or handle 166 that is sized and configured for grasping. A lower portion of each rocker link 160 is rotatably coupled to a respective reciprocating link 140, as described above, thereby defining a respective pivot axis designated as A1 in FIG. 5). More specifically, each reciprocating link 140 is rotatably coupled to a respective adjustment member or sleeve 164, which in turn, is slidably mounted on a respective rocker link 160. As a matter of design choice, any of several known means may be used to selectively relocate each sleeve 164 along a respective rocker link 160. For example, as shown in FIG. 2, "ball-detent" push-pins 165 may be inserted through holes in respective sleeves 164 and into any of a plurality of holes 162 disposed along a respective rocker link 160 (at different distances from the pivot axis P. As another example, linear actuators may be interconnected between respective reciprocating links 140 and respective rocker links 160 (in lieu of the pins 165), and placed in operational communication with the optional user interface described above.

Figure 6:
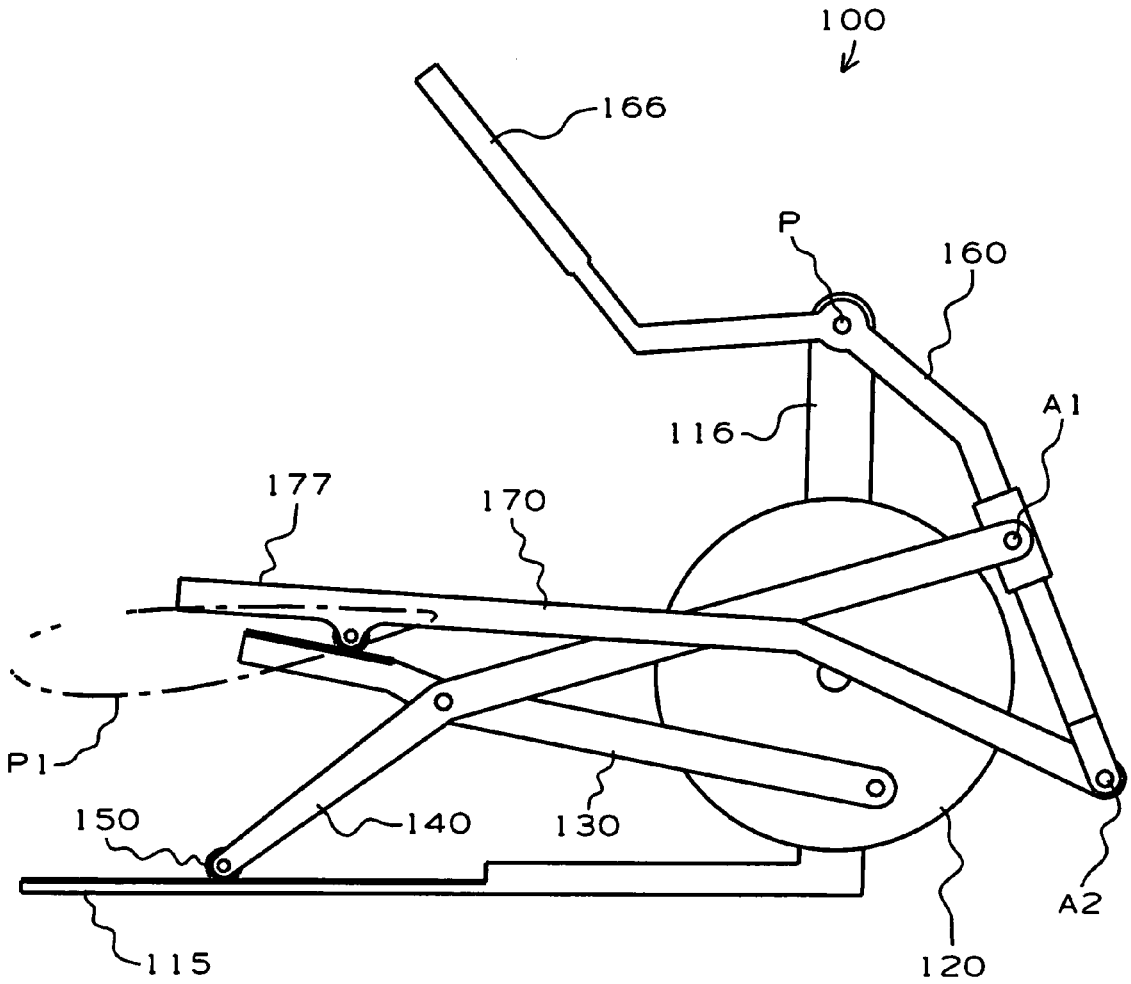
FIG. 6 is a diagrammatic side view of one side of the exercise apparatus of FIG. 1, showing a path traversed by a person's feet when the apparatus is configured as shown.
Figure 7:
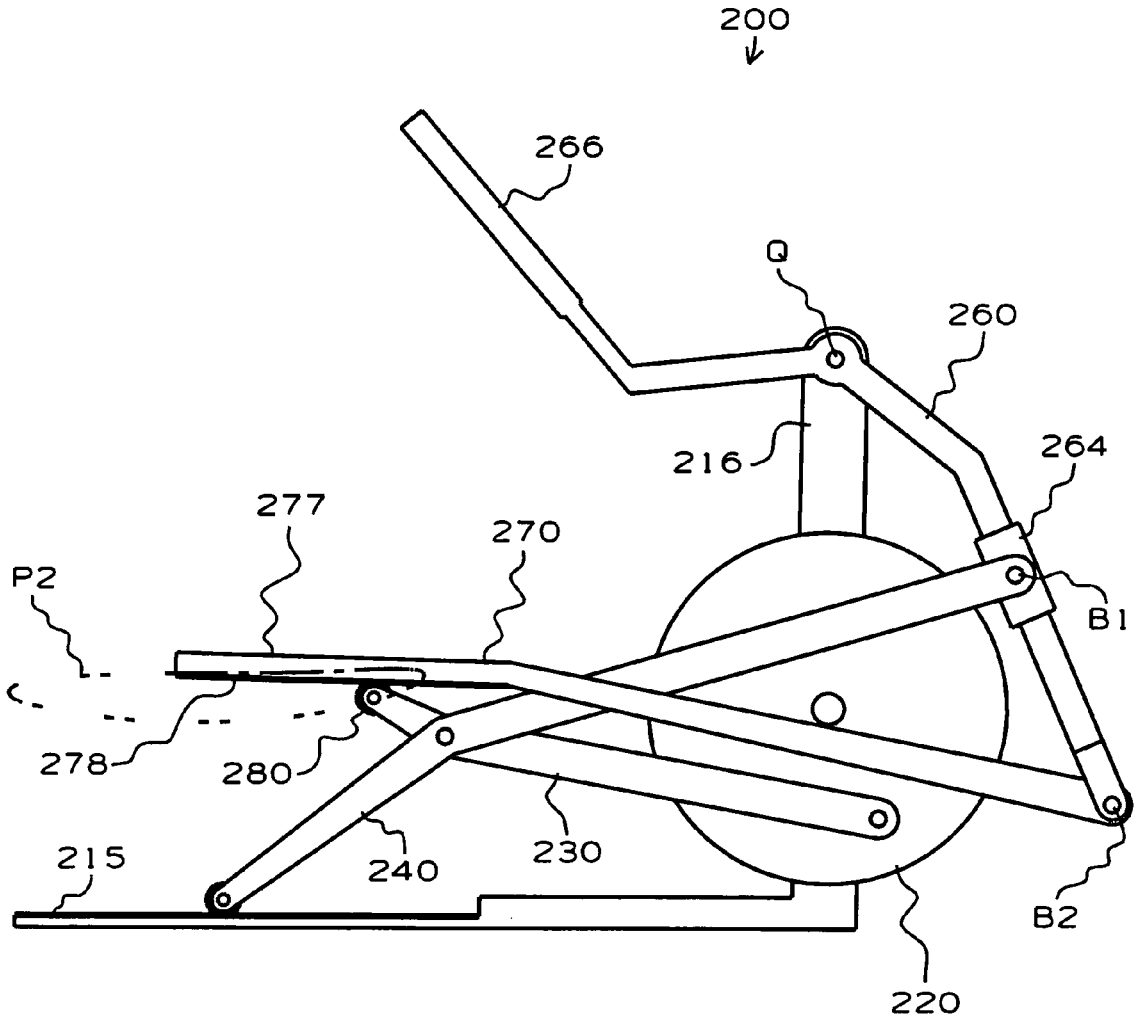
FIG. 7 is a diagrammatic side view of an alternative embodiment exercise apparatus, showing a path traversed by a person's feet when the apparatus is configured as shown.

A lower end of each rocker link 160 is rotatably coupled to the forward end of a respective foot link 170 (at a respective pivot axis designated as A2 in FIGS. 6-7). Each foot link 170 has an opposite, rearward portion or foot platform 177 that is sized and configured to support a person's respective foot. Left and right rollers 180 are rotatably coupled to rearward portions of respective left and right foot links 170. Each roller 180 is configured and arranged to roll along a respective guide or track 138 on the rearward portion of a respective drive link 130, and may also be described as cooperating with a respective track 138 to accommodate movement of a respective foot platform 177 in both pivotal and translational fashion relative to a respective drive link 130.

Operation of the apparatus 100 shall be described with reference to FIG. 6, wherein only the right side linkage assembly is shown for clarity of illustration. A person or user places his feet on respective foot platforms 177, and grasps the handles 166 in his respective hands. By exerting force through the foot platforms 177 and/or the handles 166, the user causes the linkage assemblies to move relative to the frame 110, and the cranks 120 link movement of the right linkage assembly to movement of the left linkage assembly. FIG. 6 shows the pivot axis A1 moved away from the pivot axis A2 (and toward the pivot axis P). In other words, the radial distance between the pivot axis P and the pivot axis Al is significantly less than the radial distance between the pivot axis P and the pivot axis A2. When the apparatus 100 is configured in this manner, the drawbar links 150 move the pivot axes A2 through a relatively longer, rocker-amplified arc, and the foot platforms 177 travel through a relatively long elliptical path P1. Among other things, it is worth noting that the path P1 has a major axis that is longer than a crank diameter defined between the connection points of the drive links 130 and respective cranks 120. Relatively shorter foot paths may be generated by relocating the pivot axes A1 further away from the pivot axis P and closer to respective pivot axes A2.

Persons skilled in the art will also recognize that the magnitude of hand movement is linked to the magnitude of foot movement. In other words, an increase in the stroke length of the foot supports 177 simultaneously results in an increase in the stroke length of the handles 166. Persons skilled in the art will also recognize that the linkage assembly components may be adjusted in alternative manners, as well. For example, the reciprocating links may be secured in the locations shown in FIG. 6, and the foot links may be adjustable along the rocker links. As another example, both pivot axes A1 and A2 may be fixed in the locations shown in FIG. 6, and the rocker links may be relocated relative to the pivot axis P. Adjustments to other parts of the apparatus 100 may be made in addition and/or in the alternative. For example, the tracks 115 may be modified to be selectively reoriented relative to the base 112 to change the orientation of the foot paths. In any event, it will also be recognized that such adjustments may be made manually, using pins 165 for example, or in response to a control signal, using linear actuators, for example. Moreover, the feature of selective adjustability may be replaced by force responsive adjustability, whereby spring/damper assemblies are substituted for the push-pins 165 and accommodate an ongoing, analog type of adjustment in response to force exerted by a person while exercising on the apparatus 100.

FIG. 7 shows an alternative embodiment exercise apparatus 200 constructed according to the principles of the present invention. In many respects, the apparatus 200 is operationally similar to the preferred embodiment 100. However, the apparatus 200 has rollers rotatably mounted on the drive links 230 and through a relatively longer, rocker-amplified arc, and the foot platforms 177 travel through a relatively long elliptical path P1. Among other things, it is worth noting that the path P1 has a major axis that is longer than a crank diameter defined between the connection points of the drive links 130 and respective cranks 120. Relatively shorter foot paths may be generated by relocating the pivot axes A1 further away from the pivot axis P and closer to respective pivot axes A2.

Persons skilled in the art will also recognize that the magnitude of hand movement is linked to the magnitude of foot movement. In other words, an increase in the stroke length of the foot supports 177 simultaneously results in an increase in the stroke length of the handles 166. Persons skilled in the art will also recognize that the linkage assembly components may be adjusted in alternative manners, as well. For example, the reciprocating links may be secured in the locations shown in FIG. 6, and the foot links may be adjustable along the rocker links. As another example, both pivot axes A1 and A2 may be fixed in the locations shown in FIG. 6, and the rocker links may be relocated relative to the pivot axis P. Adjustments to other parts of the apparatus 100 may be made in addition and/or in the alternative. For example, the tracks 115 may be modified to be selectively reoriented relative to the base 112 to change the orientation of the foot paths. In any event, it will also be recognized that such adjustments may be made manually, using pins 165 for example, or in response to a control signal, using linear actuators, for example. Moreover, the feature of selective adjustability may be replaced by force responsive adjustability, whereby spring/damper assemblies are substituted for the push-pins 165 and accommodate an ongoing, analog type of adjustment in response to force exerted by a person while exercising on the apparatus 100.

FIG. 7 shows an alternative embodiment exercise apparatus 200 constructed according to the principles of the present invention. In many respects, the apparatus 200 is operationally similar to the preferred embodiment 100. However, the apparatus 200 has rollers rotatably mounted on the drive links 230 and underlying the foot links 270, rather than rollers 180 rotatably mounted on the foot links 170 and rollable on the drive links 130.

Generally speaking, the apparatus 200 includes a frame that is not shown in its entirety. Among other things, the frame includes an upper stanchion member 216 and rearward guides or tracks 215. Additional frame elements are interconnected between these two components to define a rigid frame that is configured to rest on a floor surface, and support left and right linkage assemblies above the floor surface.

Left and right cranks 220 are rotatably mounted on opposite sides of the stanchion member 216, and constrained to rotate together relative thereto. Left and right drive links 230 have forward ends that are rotatably coupled to respective cranks 220, intermediate portions that are rotatably coupled to respective reciprocating links 240, and rearward ends that move through respective elliptical paths. Each reciprocating member 240 has a rearward end that is rotatably coupled to a respective roller 250, an intermediate portion that is rotatably coupled to a respective drive link 230, as described above, and a forward end that is rotatably coupled to a respective rocker link 260. The rollers 250 are configured and arranged to roll back and forth along respective tracks 215, and each roller 250 may also be described as cooperating with a respective track 215 to constrain an respective rearward end to move in reciprocal fashion relative to the frame 210.

An intermediate portion of each rocker link 260 is rotatably mounted on a respective side of the forward stanchion members 216, thereby defining a common pivot axis Q. Each rocker link 260 has an upper distal end or handle 266 that is sized and configured for grasping. A respective sleeve 265 is slidably mounted on a lower portion of each rocker link 260, and rotatably coupled to a respective reciprocating link 240, as described above, thereby defining a respective pivot axis designated as B1. As described with reference to the preferred embodiment 100, any of several known means may be used to selectively relocate each sleeve 264 along a respective rocker link 260.

A lower end of each rocker link 260 is rotatably coupled to the forward end of a respective foot link 270 at a respective pivot axis B2. Each foot link 270 has an opposite, rearward portion or foot platform 277 that is sized and configured to support a person's respective foot. Left and right guides or tracks 278 face downward from the rearward portions of respective foot links 270 and are supported on top of respective left and right rollers 280 that are rotatably mounted on the rearward ends of respective drive links 230. Each roller 280 may be described as cooperating with a respective track 278 to accommodate movement of a respective foot platform 277 in both pivotal and translational fashion relative to a respective drive link 230.

When the apparatus 200 is configured as shown in FIG. 7, the reciprocating links 240 move the pivot axes B2 through a relatively longer, rocker-amplified arc, and the foot platforms 277 travel through a relatively long elliptical path P2. Relatively shorter foot paths may be generated by relocating the pivot axes B1 further away from the pivot axis Q and closer to respective pivot axes B2.

The present invention may also be described in terms that are common to both embodiments, and/or that take into account other possible variations. For example, each reciprocating link and associated drive link may be described as a respective linkage, in which case, each foot link may be described as having a rearward, foot supporting end that is movably supported on a respective linkage. The present invention may also be recited in terms of methods that are performed in making and/or using the embodiments disclosed herein. The present invention has been described with the understanding that persons skilled in the art will recognize additional embodiments, improvements, and/or applications that nonetheless fall within the scope of the invention. Therefore, the scope of the present invention should be limited only to the extent of the following claims.

What is claimed is:

1. An elliptical motion exercise apparatus, comprising:

a frame configured to rest on a floor surface;

a left crank and a right crank, wherein each said crank is rotatably mounted on the frame;

a left drive link and a right drive link, wherein each said drive link has a forward end, a rearward end, and an intermediate portion disposed therebetween, and each said forward end is rotatably coupled to a respective said crank;

a left rocker link and a right rocker link, wherein each said rocker link is rotatably mounted on the frame at a common pivot axis;

a left reciprocating link and a right reciprocating link, wherein each said reciprocating link has a forward end rotatably coupled to a lower portion of a respective said rocker link, a rearward end constrained to move in reciprocal fashion relative to the frame, and an intermediate portion rotatably coupled to the intermediate portion of a respective said drive link, and the left reciprocating link and the left drive link cooperate to define a left linkage, and the right reciprocating link and the right drive link cooperate to define a right linkage; and a left foot link and a right foot link, wherein each said foot link has a forward end rotatably coupled to a lower portion of a respective said rocker link, and a rearward, foot supporting end movably supported on a respective said linkage.

2. The apparatus of claim 1, wherein a left roller is rotatably mounted on the rearward end of the left foot link and rollable along a guide on the left drive link, and a right roller is rotatably mounted on the rearward end of the right foot link and rollable along a guide on the right drive link.

3. The apparatus of claim 2, wherein each said rocker link and a respective said reciprocating link cooperate to define a respective first pivot axis disposed at a first radial distance from the common pivot axis, and each said rocker link and a respective said foot link cooperate to define a respective second pivot axis disposed at a relatively greater, second distance from the common pivot axis.

4. The apparatus of claim 3, wherein each said first pivot axis is selectively movable along a respective said rocker link.

5. The apparatus of claim 3, wherein a left reciprocating roller is rotatably mounted on the rearward end of the left reciprocating link, and a right reciprocating roller is rotatably mounted on the rearward end of the right reciprocating link, and each said reciprocating roller is configured and arranged to roll along a respective guide on the frame.

6. The apparatus of claim 1, wherein the rearward end of the left foot link is rollable across a left roller that is rotatably mounted on the left drive link, and the rearward end of the right foot link is rollable across a right roller that is rotatably mounted on the right drive link.

7. The apparatus of claim 6, wherein each said rocker link and a respective said reciprocating link cooperate to define a respective first pivot axis disposed at a first radial distance from the common pivot axis, and each said rocker link and a respective said foot link cooperate to define a respective second pivot axis disposed at a relatively greater, second distance from the common pivot axis.

8. The apparatus of claim 7, wherein each said first pivot axis is selectively movable along a respective said rocker link.

9. The apparatus of claim 8, wherein a left reciprocating roller is rotatably mounted on the rearward end of the left reciprocating link, and a right reciprocating roller is rotatably mounted on the rearward end of the right reciprocating link, and each said reciprocating roller is configured and arranged to roll along a respective guide on the frame.

10. The apparatus of claim 1, wherein each said rocker link and a respective said drive link cooperate to define a respective first pivot axis disposed at a first radial distance from the common pivot axis, and each said rocker link and a respective said foot link cooperate to define a respective second pivot axis disposed at a relatively greater, second distance from the common pivot axis.

11. The apparatus of claim 10, wherein each said first pivot axis is selectively movable along a respective said rocker link.

12. The apparatus of claim 10, wherein a left reciprocating roller is rotatably mounted on the rearward end of the left reciprocating link, and a right reciprocating roller is rotatably mounted on the rearward end of the right reciprocating link, and each said reciprocating roller is configured and arranged to roll along a respective guide on the frame.

13. An elliptical motion exercise apparatus, comprising:

a frame configured to rest on a floor surface;

a left crank and a right crank, wherein each said crank is rotatably mounted on the frame;

a left drive link and a right drive link, wherein each said drive link has a forward end, a rearward end, and an intermediate portion disposed therebetween, and each said forward end is rotatably coupled to a respective said crank;

a left rocker link and a right rocker link, wherein each said rocker link is rotatably mounted on the frame at a common pivot axis;

a left reciprocating link and a right reciprocating link, wherein each said reciprocating link has a forward end rotatably coupled to a lower portion of a respective said rocker link, a rearward end constrained to move in reciprocal fashion relative to the frame, and an intermediate portion rotatably coupled to the intermediate portion of a respective said drive link; and a left foot link and a right foot link, wherein each said foot link has a forward end rotatably coupled to a lower portion of a respective said rocker link, and a rearward, foot supporting end movably supported on a respective said drive link.

14. The apparatus of claim 13, wherein a left roller is rotatably mounted on the rearward end of the left foot link and rollable along a guide on the left drive link, and a right roller is rotatably mounted on the rearward end of the right foot link and rollable along a guide on the right drive link.

15. The apparatus of claim 14, wherein each said rocker link and a respective said reciprocating link cooperate to define a respective first pivot axis disposed at a first radial distance from the common pivot axis, and each said rocker link and a respective said foot link cooperate to define a respective second pivot axis disposed at a relatively greater, second distance from the common pivot axis.

16. The apparatus of claim 15, wherein each said first pivot axis is selectively movable along a respective said rocker link.

17. The apparatus of claim 15, wherein a left reciprocating roller is rotatably mounted on the rearward end of the left reciprocating link, and a right reciprocating roller is rotatably mounted on the rearward end of the right reciprocating link, and each said reciprocating roller is configured and arranged to roll along a respective guide on the frame.

18. The apparatus of claim 13, wherein the rearward end of the left foot link is rollable across a left roller that is rotatably mounted on the left drive link, and the rearward end of the right foot link is rollable across a right roller that is rotatably mounted on the right drive link.

19. The apparatus of claim 18, wherein each said rocker link and a respective said reciprocating link cooperate to define a respective first pivot axis disposed at a first radial distance from the common pivot axis, and each said rocker link and a respective said foot link cooperate to define a respective second pivot axis disposed at a relatively greater, second distance from the common pivot axis.

20. The apparatus of claim 19, wherein each said first pivot axis is selectively movable along a respective said rocker link.

21. The apparatus of claim 20, wherein a left reciprocating roller is rotatably mounted on the rearward end of the left reciprocating link, and a right reciprocating roller is rotatably mounted on the rearward end of the right reciprocating link, and each said reciprocating roller is configured and arranged to roll along a respective guide on the frame.

22. The apparatus of claim 13, wherein each said rocker link and a respective said drive link cooperate to define a respective first pivot axis disposed at a first radial distance from the common pivot axis, and each said rocker link and a respective said foot link cooperate to define a respective second pivot axis disposed at a relatively greater, second distance from the common pivot axis.

23. The apparatus of claim 22, wherein each said first pivot axis is selectively movable along a respective said rocker link.

24. The apparatus of claim 22, wherein a left reciprocating roller is rotatably mounted on the rearward end of the left reciprocating link, and a right reciprocating roller is rotatably mounted on the rearward end of the right reciprocating link, and each said reciprocating roller is configured and arranged to roll along a respective guide on the frame.

* * * * *